US007902442B2

(12) United States Patent
Leach

(10) Patent No.: US 7,902,442 B2
(45) Date of Patent: Mar. 8, 2011

(54) HINGE FOR TRAVEL STRING INSTRUMENT

(75) Inventor: Harvey Leach, Cedar Ridge, CA (US)

(73) Assignee: Voyage-Air Inc., Pleasanton, CA (US)

( * ) Notice: Subject to any disclaimer, the term of this patent is extended or adjusted under 35 U.S.C. 154(b) by 975 days.

(21) Appl. No.: 11/732,846

(22) Filed: Apr. 3, 2007

(65) Prior Publication Data

US 2008/0141488 A1 Jun. 19, 2008

Related U.S. Application Data

(63) Continuation-in-part of application No. 11/640,095, filed on Dec. 15, 2006, now Pat. No. 7,652,205.

(51) Int. Cl.
*G10D 3/00* (2006.01)

(52) U.S. Cl. ..... 84/293

(58) Field of Classification Search ..... 84/293
See application file for complete search history.

(56) References Cited

U.S. PATENT DOCUMENTS

| | | | | | |
|---|---|---|---|---|---|
| 825,943 | A * | 7/1906 | Soss | 16/358 |
| 1,009,108 | A * | 11/1911 | Soss | 16/366 |
| 1,484,093 | A * | 2/1924 | Soss | 16/358 |
| 2,021,702 | A * | 11/1935 | Soss | 16/369 |
| 3,881,221 | A * | 5/1975 | Schmidt | 16/366 |
| 3,886,627 | A * | 6/1975 | Bassan | 16/387 |
| 4,111,093 | A * | 9/1978 | Field et al. | 84/267 |
| 4,780,929 | A * | 11/1988 | Burns et al. | 16/349 |
| 5,044,044 | A * | 9/1991 | Young et al. | 16/323 |
| 5,233,896 | A * | 8/1993 | Worthington et al. | 84/293 |
| 6,353,164 | B1 * | 3/2002 | Corsi | 84/293 |
| D516,114 | S * | 2/2006 | Leach | D17/20 |
| 7,100,231 | B2 * | 9/2006 | Peschmann | 14/69.5 |
| 7,365,254 | B2 * | 4/2008 | Johansson | 84/293 |
| 7,579,535 | B2 * | 8/2009 | Pyper-Scott | 84/293 |
| 7,652,205 | B2 * | 1/2010 | Leach | 84/293 |
| 7,696,419 | B2 * | 4/2010 | Chadwick | 84/293 |
| 7,705,224 | B1 * | 4/2010 | Ward | 84/267 |
| 7,754,950 | B2 * | 7/2010 | Leach | 84/293 |
| 7,816,592 | B2 * | 10/2010 | Babicz | 84/293 |
| 2007/0289427 | A1 * | 12/2007 | Liang | 84/291 |

* cited by examiner

*Primary Examiner* — Elvin G Enad
*Assistant Examiner* — Robert W Horn
(74) *Attorney, Agent, or Firm* — Handal & Morofsky LLC; Anthony H. Handal

(57) ABSTRACT

The inventive hinge includes a first hinge butt defining a pair of first and second races for receiving a first Soss sliding hinge pin. A second hinge butt defines a pair of third and fourth races for receiving a second Soss sliding hinge pin. The first hinge butt includes a first screw hole and the second hinge butt includes a second screw hole. A first Soss link assembly is mounted between and in the first and third races. A second Soss link assembly is mounted between and in the second and fourth races, the second Soss link assembly being positioned adjacent and spaced apart from, as well as extending in the same direction as the first Soss link assembly.

18 Claims, 10 Drawing Sheets

HINGE FOR TRAVEL STRING INSTRUMENT

CROSS-REFERENCE TO RELATED APPLICATION

This application is a continuation-in-part application of U.S. application Ser. No. 11/640,095, filed Dec. 15, 2006 now U.S. Pat. No. 7,652,205.

BACKGROUND OF INVENTION

The manufacture of note producing musical instruments began as a search for the mechanical equivalent of the human voice. This in fact remained the standard through the Middle Ages and into the Renaissance and the early modern period.

Stringed instruments have been known since ancient times. These included such instruments as the lute, a guitar-like instrument with a sound box and fingerboard. A New Kingdom (ancient Egypt, 1380 BC) bronze in the collection of the Metropolitan Museum of Art depicts a dancing Nubian raised on his toes with one knee cocked, left hand high working a fingerboard and right hand plucking the strings in a pose which might be illustrative of a modern rock musician.

But the lute has a much more ancient history, perhaps originating with West Semitic nomadic people who brought the instrument to Mesopotamia, where the archaeological record includes representations dating back to the Akkadian period (2350 to 2170 B.C.), being introduced to the Egyptians, perhaps at the end of the Middle Kingdom Hyksos dynasties (XV to XVII dynasty, 1730 to 1580 B.C.).

In more recent times, stringed lute-like musical instruments continue to be among the most popular instruments. Folk artists throughout the United States have used the guitar, sometimes one of the homemade variety, in a wide range of musical genres including blues, bluegrass, and so forth.

In contrast to percussive instrumentation, the need for amplification of the relatively weak sounds of strings, reeds, and vibrating human lips presented challenges to early musical instrument manufacturers. These challenges were met primarily by resonant systems that mechanically concentrate, to a greater or lesser degree control phase (and thus its integral, frequency or pitch), and output musical sound. The result is a demanding standard in the stability of the instrument if high-quality sound is to be produced.

Moreover, over the years, artists playing acoustic stringed instruments have introduced a wide variety of playing techniques into the music surrounding these instruments. While, perhaps, the ancients only plucked the strings of the lute to achieve a musical tone which gradually decayed, later artists used the bow to produce notes of relatively constant and somewhat controllable amplitude. Modern artists employ a variety of techniques in their performances. Acoustic blues performers may rap their instruments with fingertips, palms or knuckles. Certain violin compositions, typically played by having a horsehair bundle slide across the strings, also call for the strings to be plucked. This results in yet greater demands being put on the mechanical stability of the instrument.

Given the popularity of stringed musical instruments, especially the guitar, people often take them along when traveling. However, they are bulky and poorly suited to convenient transport. They are unlikely to fit into airlines stowaway spaces or under airline seats. In response to this need, guitars with folding necks have been proposed. See for example my earlier U.S. Design Pat. No. 516,114. While this instrument is effective, it is difficult to make requiring significant handwork and fine tuning.

Accordingly, there is a need for a stringed instrument which may be a guitar, violin or the like and which is easy to use during a performance, consistent, and rigorous in its transduction of artistic interpretations into an acoustic or other performance and easily transportable. It is believed that the structure disclosed herein is the most effective solution consistent with the style of many acoustic stringed instrument performers.

This invention also relates to hinges and particularly what is commonly known as invisible hinges for the use in connection with doors and other swinging articles and the invention described here is an improvement on previous designs for the specific use where a very narrow surface is available for the hinge mechanism and the hinge must be able to support a proportionally much longer perpendicular surface. Also significant to this invention is the method used to locate and install the hinges.

In this type of hinge the hinge parts are connected by pivoted linkages hinged on a hinge pin and sliding on sliding pins, the linkages being within pockets or compartments within the hinge parts, that is the hinge plates or butt plates. An early version of such hinges is a hinge design created by Joseph Soss and bearing his name. It is illustrated in several patents including U.S. Pat. Nos. 1,030,936, 1,484,093, 1,688,996, 1,984,092, and 2,178,271 among others. A hinge of this sort is employed in the above referenced design patent.

These hinges are designed to be invisible when in the closed position and allow for the focal point of the hinge to be below the surface when in the closed position and then extend beyond the surface to allow for a full 180 degree opening. Two basic versions of the hinge are common, the first having a long narrow body with two attachment screws, one located at each end. This style is of a shape requiring a multi-level mortise cut for installation, the second is a cylinder or barrel hinge with a side mounted screw as a means of attachment and requiring a hole to be bored for installation.

These previous designs are of a similar nature but either lack the clearance necessary, have methods of attachment that are either insufficient or impractical in a guitar with a folding neck and also require a complex process to create the openings for the hinge butt plates or cylinders.

Furthermore, while a version of the previous design has been proven capable of supporting this application to some extent in above U.S. Design Pat. No. D516,114, it has been found lacking in several areas with regard to effective production beyond the small, hand assembly shop.

First, these hinges, known as "barrel hinges," require a final outer surface, an example being a fretboard on musical instruments, to be attached out of sequence with normal production procedure and require holes to be bored extremely close to the surface of the fretboard weakening this vital structural member.

Second, these hinges are very difficult to set accurately with respect to depth and alignment. The other version of Soss hinge has better means of securement and greater location and depth control. However, its design only allows for a single hinge to fit in the required area which lacks the structural integrity for this application and lacks sufficient capability to adequately align the two hinged parts. Furthermore, the location of the securement screws is too close to the outer edges of the members, which in this application creates problems because of the lack of material for the screws to properly secure themselves. Currently available versions also lack the opening clearance needed for guitar hinge application.

Finally, the means required to cut the mortises is very time consuming and difficult to consistently achieve.

SUMMARY OF INVENTION

In accordance with the invention, a string instrument comprises a neck extension primary member having a neck extension securement end and a tuning assembly support head end, an extension top and a length extending between the ends. The neck extension primary member defines a neck extension cutaway volume configured to receive a hinge butt. The neck extension cutaway volume extends to be open at the neck extension securement end and open at the top of the neck extension primary member. A neck base primary member has a neck base securement end, a base top and an opposite end. The neck base primary member is made to define a neck base cutaway volume configured to receive a hinge butt. The neck base cutaway volume extends to be open at the neck base securement end and open at the top of the neck base primary member. A hinge has a first hinge butt positioned in the neck extension cutaway volume and a second hinge butt positioned in the neck base cutaway volume. A neck fretboard portion is secured over the open top of the neck extension cutaway volume and bears against the first hinge butt. A base cover is secured over the open top of the neck base cutaway volume and bears against the second hinge butt. A string instrument main body is secured to the neck base primary member.

Two or more Soss link assemblies are connected to a single pair of hinge butts, with each of the butts defining a pair of Soss hinge link receiving races, to form a pair of spaced apart Soss hinge assemblies formed on the single pair of hinge butts.

The hinge butts each define a securement screw receiving bore oriented to extend the length of the string instrument neck.

The neck extension primary member is provided with a mounting for a screw and the neck base primary member defines a hole for receiving that screw. This allows the neck base primary member and the neck extension primary member to be secured in the playing position.

The inventive hinge comprises a first hinge butt defining a pair of first and second races for receiving a first Soss sliding hinge pin. A second hinge butt defines a pair of third and fourth races for receiving a second Soss sliding hinge pin. A first Soss link assembly is mounted between and in the first and third races. A second Soss link assembly is mounted between and in the second and fourth races, the second Soss link assembly being positioned adjacent and spaced apart from, as well as extending in the same direction as the first Soss link assembly.

In accordance with the preferred embodiment, the first hinge butt defines a hole between the first and second races. The second hinge butt defines a hole between the third and fourth races. The hole is oriented to receive an attachment member for urging and attaching the hinge into a member to be hingedly mounted.

The hinge butts may be rectangular in configuration with flat sides and rounded corners or flat sides and for example pointed substantially 90° corners.

The hole between the first and said second races may be aligned substantially in the same direction as the races.

BRIEF DESCRIPTION OF THE DRAWINGS

The structure and method of construction of a guitar constructed in accordance with the invention will be understood from the following drawings, taken in conjunction with the description below, and in which.

DETAILED DESCRIPTION OF EMBODIMENTS OF THE INVENTION

Figure 1:
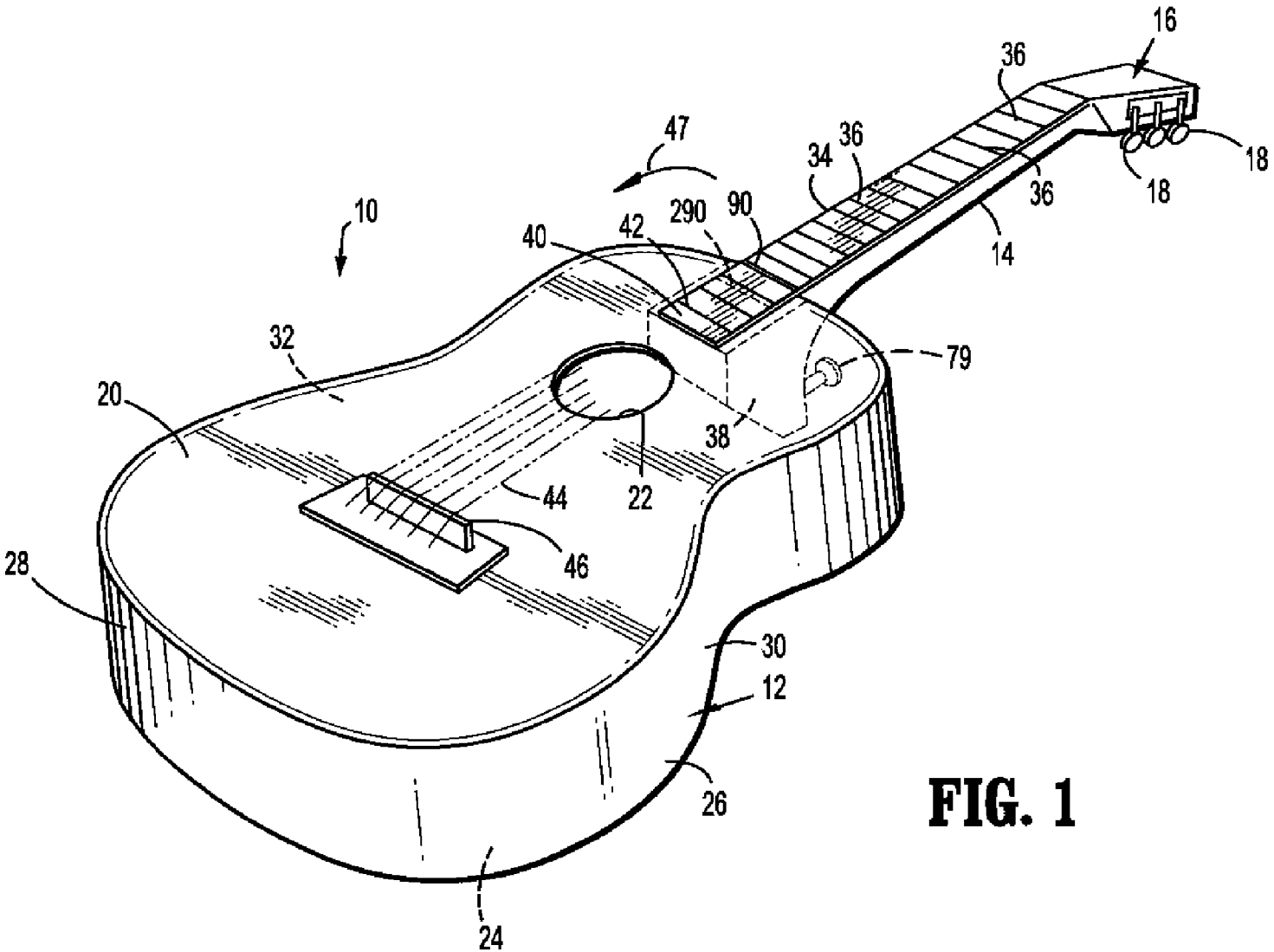
FIG. 1 is a prospective view of one embodiment of the inventive stringed musical instrument, in this case an acoustical guitar, in a playing position, viewed from the top side.

Referring to FIG. 1, a musical instrument constructed in accordance with the present invention is illustrated. While the invention may be employed in connection with acoustic or electrical guitars, violins, violas, bases, banjos or other stringed instruments, for purposes of illustration an acoustical guitar 10 is illustrated.

Generally, guitar 10 comprises a large hollow body 12, secured to the inventive neck 14. Neck 14 comprises a head 16, which accommodates tuning screws 18 in a conventional manner.

Body 12 comprises top plate 20 which defines a sound hole 22. But the plate 24 is secured to top plate 20 by bouts 26 and 28 which together form a guitar sound box sidewall having U-shaped upper and lower ends at the heel and tail ends of the body 12, and a curved central bout 30 and curved central bout 32 (not illustrated) which form the waist of the instrument.

Neck 14 supports a neck fretboard 34, which is glued to neck 14. Neck fretboard 34 supports a plurality of frets 36. Neck base 38 supports a neck base fretboard 40, which is glued to neck base 38. Neck base fretboard 40 supports a plurality of frets 42, against which strings 44 are played. For purposes of clarity of illustration, strings 44, which are supported by bridge 46 are illustrated partially and in phantom lines.

Figure 2:
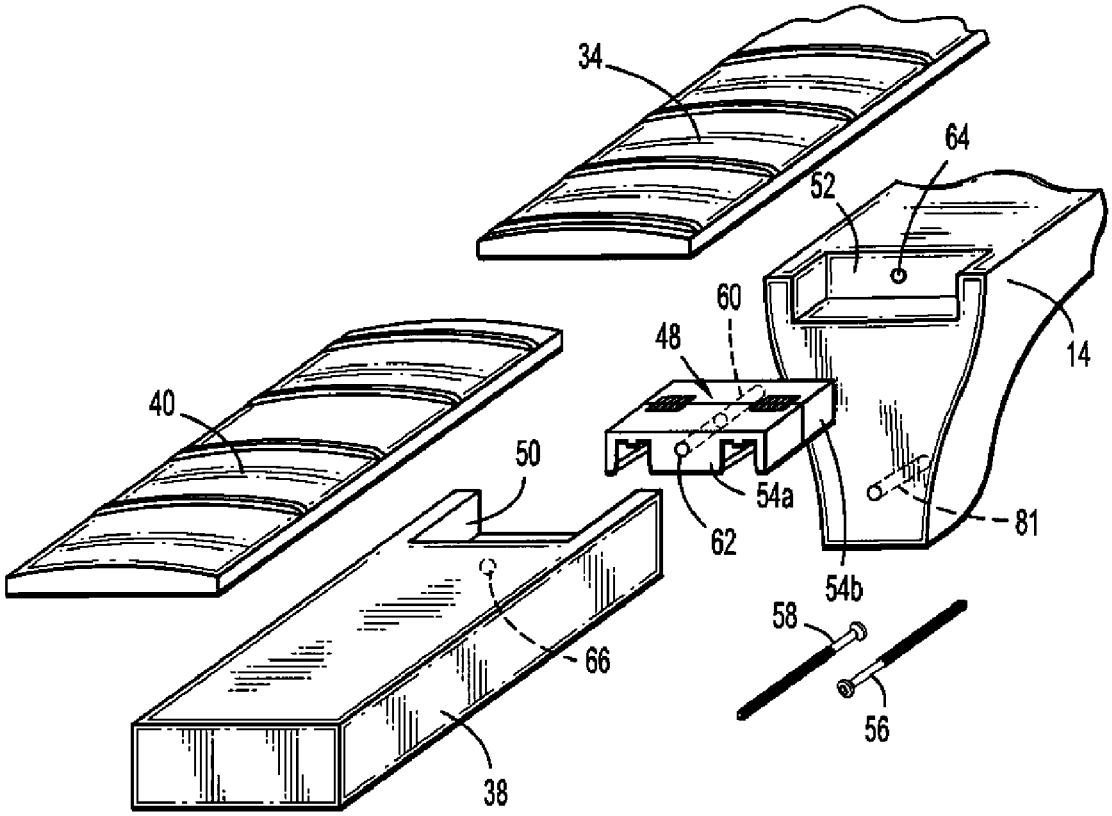
FIG. 2 is an exploded perspective view of one possible configuration of the inventive traveling stringed musical instrument.

The construction of the guitar illustrated in FIG. 1 may be understood from FIG. 2 which schematically illustrates principal parts in exploded perspective.

One of the objectives of the invention is to create a hinge that has a simpler and more easily repeatable method of installation. Moreover, in the preferred embodiment, this installation can be achieved prior to attaching the final surface, such as musical instrument fretboards 34 and 40.

The invention also provides a method of securely attaching the hinge in a manner that can be quickly and easily installed or removed. The inventive hinge cooperates with hinge pockets which may be cut into the neck parts vertically instead of horizontally, thereby simplifying the procedure. Vertical cutting of the pockets is simpler to accomplish, faster and easily repeatable with good precision.

Because of the hinge's square, box-like shape, this cut can be accomplished with a router and simple fixtures as well as more sophisticated production methods. Because this step can be accomplished very early in the machining process it allows for it to be seamlessly integrated into a process such as typical musical instrument neck building. This new design also allows for a center mounting screw which can be attached to the most structurally sound area, it also allows for more secure methods such as metal inserts or barrel nuts to be used for the screw to feed into adding strength as well as the ability to repeatedly remove the screw for production reasons as well as in future repair or replacement operations.

One of the other advantages of the preferred embodiment of the invention is the provision of a double hinge that by having two parallel hinged members can, as a single hinge, effectively do the work of two hinges which would normally require a substantially wider surface available for a pair of hinged mechanisms. The inventive hinge is configured with a greater opening clearance when the guitar neck is in the folded position. This accommodates the unique curved surfaces commonly found in items such as musical instruments. These surfaces, such as the fretboards, and the small metal frets that protrude from the fretboard also create clearance issues.

By using two hinged member sections and having the face surface squared at the ends rather than radiused the hinged members can be placed much closer to the ends of the butt plates which will allow the hinge to give greater support when the hinge is opened by folding in the direction indicated by arrow 47 in the playing position illustrated in FIG. 1 and also properly realign the surfaces when closed.

Referring to FIG. 2, an exploded perspective of the inventive system incorporating the inventive hinge 48 as it may be installed in one possible application of the present invention, namely in a musical instrument neck, is illustrated. The shapes and sizes of neck 14, neck base 38, neck fretboard 34 and base fretboard 40 may take numerous configurations without affecting the function of the hinge 48, but are shown for purposes of illustration as to how the hinge might be installed in this application.

The hinge pockets 50 and 52 are shown as they might be cut by a vertical rotary machining process. This process is easier than the methods required for previous designs, such as that illustrated in my earlier U.S. Design Pat. No. 516,114. More particularly, the method of manufacturing the guitar neck illustrated in this patent required two pairs of cylindrical hinge pockets to be cut horizontally to receive the cylindrical loans of two separate Soss hinges.

In contrast, the accuracy needed to cut pockets 50 and 52 that are proportioned to the sizes of hinge butt plates 54*a* and 54*b* and correctly located to control depth and height of the hinge installation is easily accomplished with the inventive design. This simplifies both small shop hand-cut methods as well as mass production. With the inventive method pockets 50 and 52 can be cut at any stage of manufacture prior to the attachment of neck fretboard 34 and base fretboard 40 to neck 14 and neck base 38. Such attachment may be achieved by gluing.

Once these parts are assembled they create a four-sided enclosure for the hinge butt plates to fully recess into the pockets. Two attachment screws 56 and 58 are deployed in holes 60 and 62 and screwed into holes 64 and 66, respectively. The result is that screws 56 and 58 secure the butt plates 54*a* and 54*b* to the parts. Because the screws are attached into the center of the neck 14 and neck base 38, there is greater mass for the screws to achieve a strong connection and eliminates the possibility of the screws splitting neck 14 or neck base 38. Additional attachment methods such as a barrel nut could also be used to allow for easy and repeatable installation and removal of the hinges as well as providing a very secure attachment method.

Figure 3:
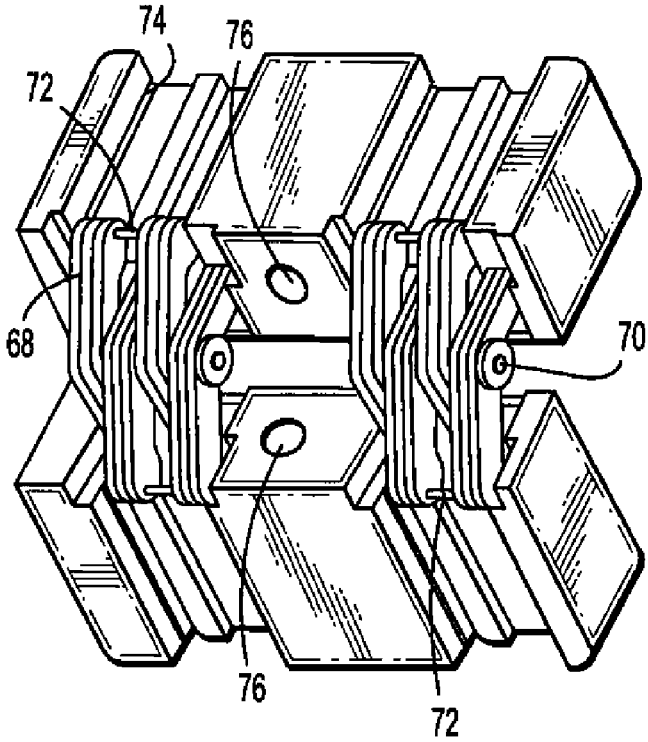
FIG. 3 is a perspective view of a hinge which may be employed in the inventive stringed musical instrument in a half-closed position, viewed from the bottom side, as the hinge would be deployed in a musical instrument such as a guitar or violin.

Referring to FIG. 1 the hinge butt plates 54*a* and 54*b* are connected, as shown in FIG. 3, by hinge links 68 and hinge pins 70 located at the top of the hinge butt plates. The links 68 are alternating left and right sets connected by hinge pin 70 at the rotation and pivot point. Hinge pins 72 are allowed to slide in recesses 74 and a manner typical of a Soss hinge. This action allows the hinge pivot pins 70 to move beyond the surface of the butt plate which allows for the necessary clearance for the guitar strings, frets and so forth.

A single center hole 76 is located in each butt plate. This location allows for a single fastening device such as a screw or bolt to be used for each butt plate.

Another advantage to the present invention is the range of ratios of hinge width to the neck of the instrument. The width of the hinge approximately ranges from one quarter to one half of the width of the neck of the instrument. The distance between the two screws that fasten each butt plate is approximately equal to the width of the neck of the instrument.

Figure 4:
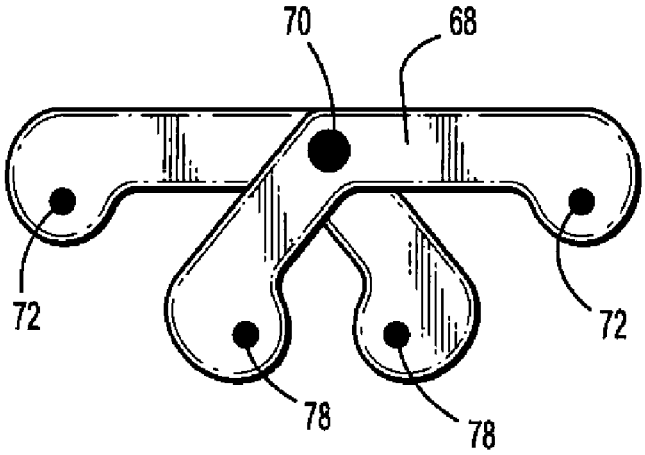
FIG. 4 is a plan view of the hinge links in a musical instrument as they would appear in the playing position.

FIG. 4 shows the approximate location of the hinge pins 70, sliding pins 72 and fixed rotation pins 78 in relation to the hinge links 68 as well as the general shape of the hinge links. The shape and location of hinge pins can be altered to create a hinge that opens further or acts differently as it is opened.

As can be seen most clearly in FIG. 1, neck 14 is secured in position by a screw 79. Screw 79 may be seen more clearly with reference to FIG. 5.

Figure 5:
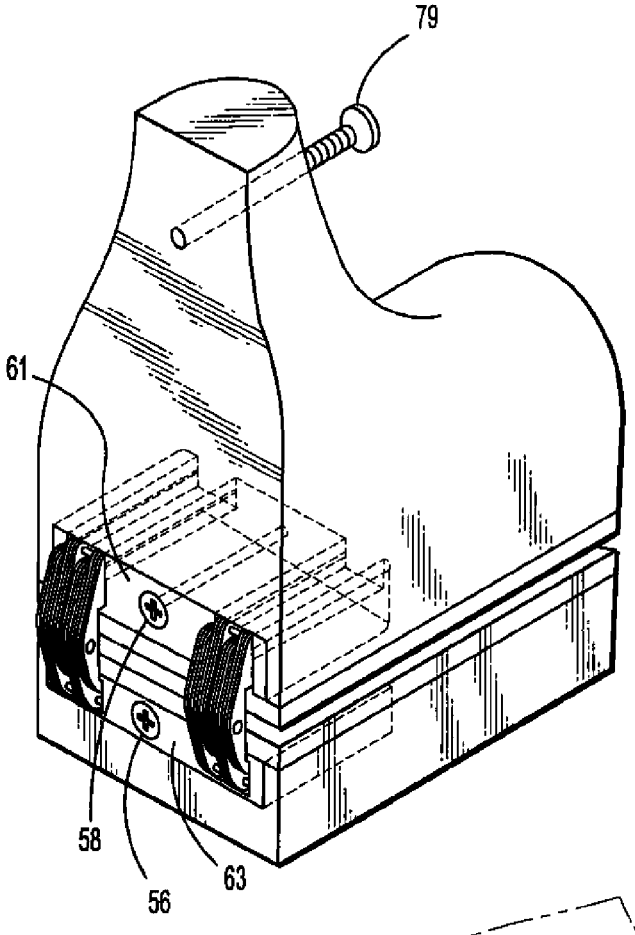
FIG. 5 is a perspective view of the hinge installed and in the open position.

FIG. 5 shows the hinge installed and in the folded position and shows how the butt plates 61 and 63 are concealed within the pockets 50 and 52 and how the attachment screws 56 and 58 are positioned in the final assembled structure. The neck 14, neck base 38, neck fretboard 34 and base fretboard 40 or illustrated in the assembled storage or travel position of the musical instrument neck. The inventive hinge may be suitable for other applications where a very narrow surface is available for the hinge mechanism and it must be able to support a proportionally much longer perpendicular surface.

Referring to FIG. 1, when the neck 14 is positioned with respect to the guitar body 12, in the open or playing position, as a result of the movement of the hinge from the position illustrated in FIG. 5 through the position illustrated in FIG. 3 and on to the position illustrated in FIG. 2, the guitar made the conveniently played after the secure of screw 79 in hole 81.

Figure 6:
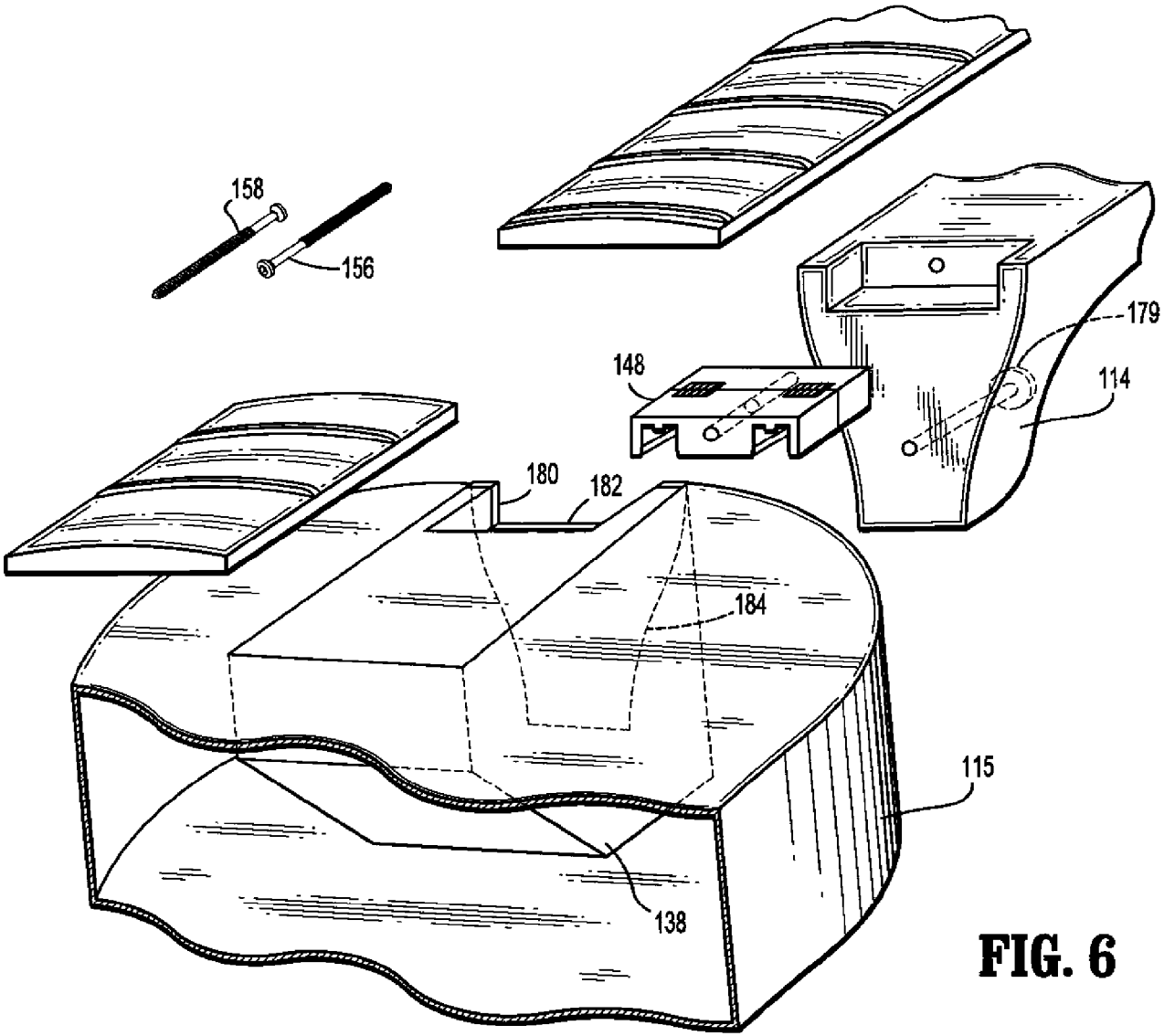
FIG. 6 is an exploded perspective view of an alternative configuration for the inventive traveling stringed musical instrument.

Referring to FIG. 6, alternative embodiments of the invention may be understood. In this embodiment, parts which perform similar or analogous functions are given reference numerals which all are 100 larger then corresponding parts in the embodiment of FIGS. 1-5. More particularly, in FIG. 6, a guitar 110 comprising a guitar body 112 has continuous sidewall bout which defines a notch 184 receiving hinge 148. A portion 182 of sidewall 115 is thus sandwiched between a heel block 138 and neck 114. Screw 179 secures neck 114 in the playing position by screwing into hole 181.

In the event that a particularly rigid securement of the neck is desired, a portion 184 of heel block 138 may alternatively extend through sidewall 115 which is cut out to match portion 184. The result is that the heel block is flush with the side wall.

Figure 7:
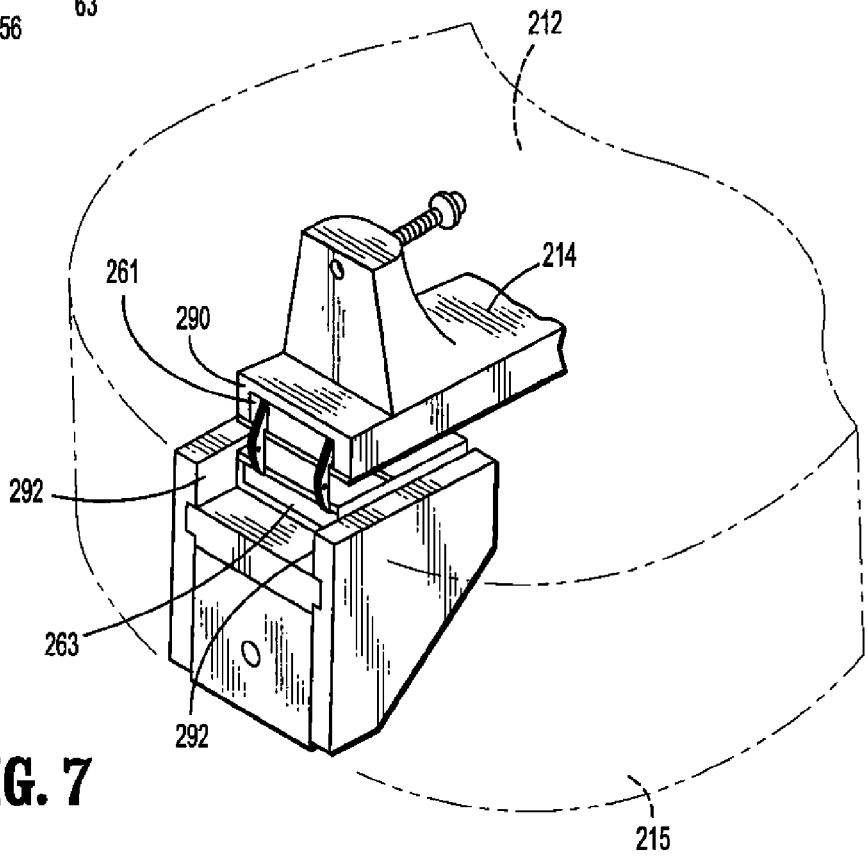
FIG. 7 illustrates the inventive instrument with the neck folded.

Still yet another alternative embodiment of the inventive guitar 210 comprising a guitar body 212 and a guitar neck 214 is illustrated in FIG. 7. In this embodiment, neck 214 folds at a breakpoint 290, which is inside from sidewalls 215 each as illustrated in FIG. 7, and as illustrated in phantom lines in FIG. 1. The result is added support for the neck 214 by sidewalls 292.

Figure 8:
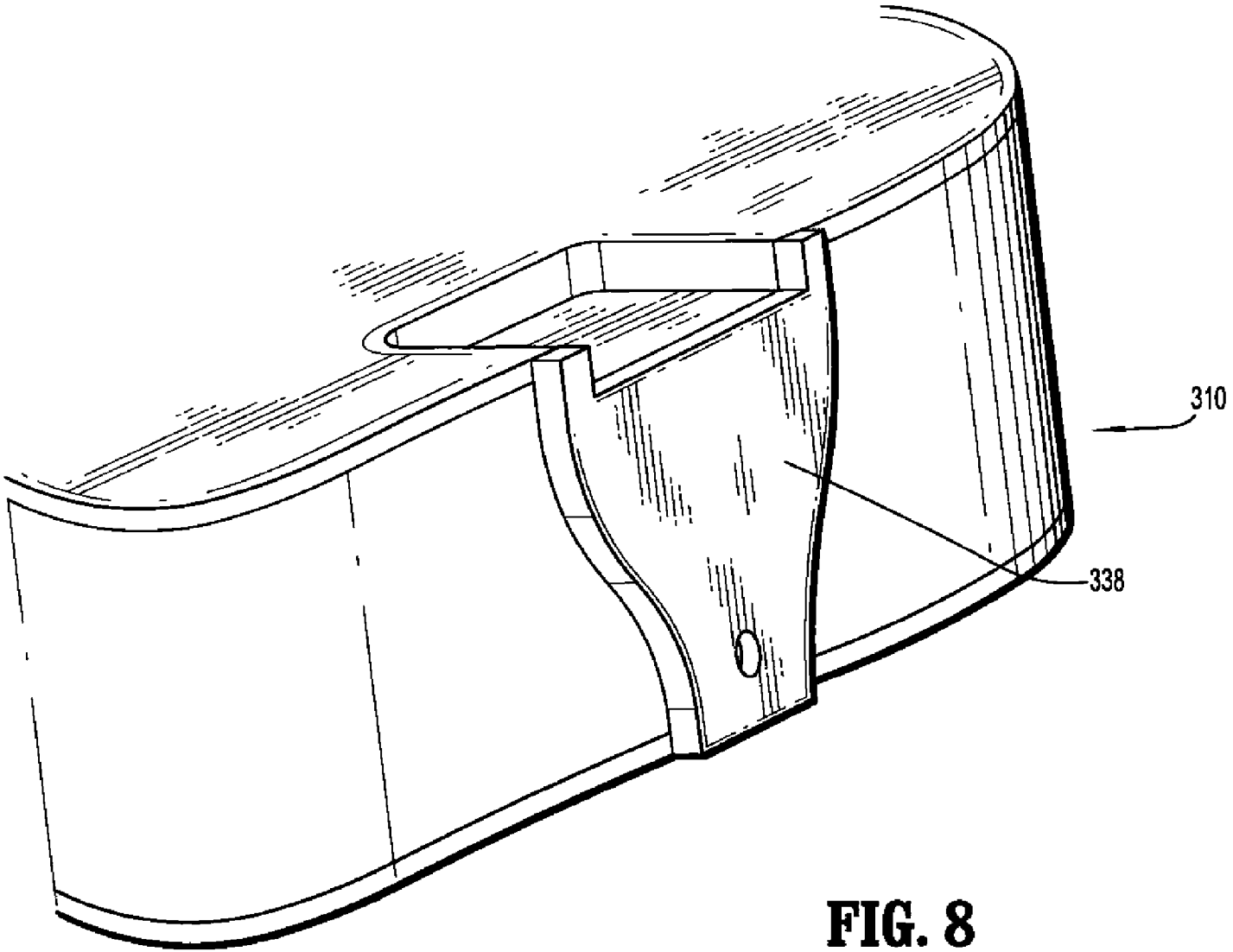
FIG. 8 illustrates an alternative embodiment with a protruding heel block.

Referring to FIG. 8, a guitar 310 incorporates a protruding heel block 338, as alluded to above.

Figure 9:
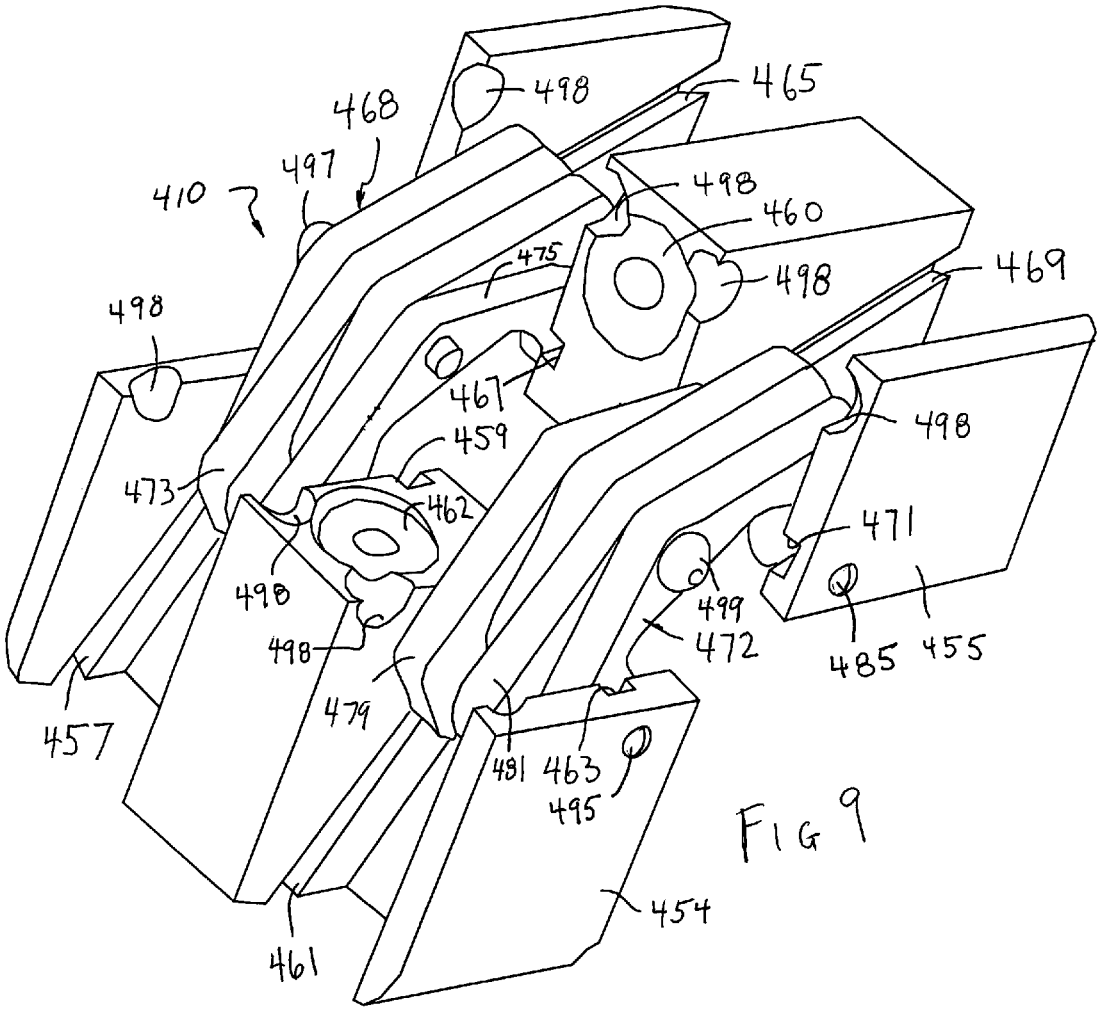
FIG. 9 is a perspective view of a hinge which may be employed in the inventive stringed musical instrument in a half-closed position, viewed from the bottom side.
Figure 10:
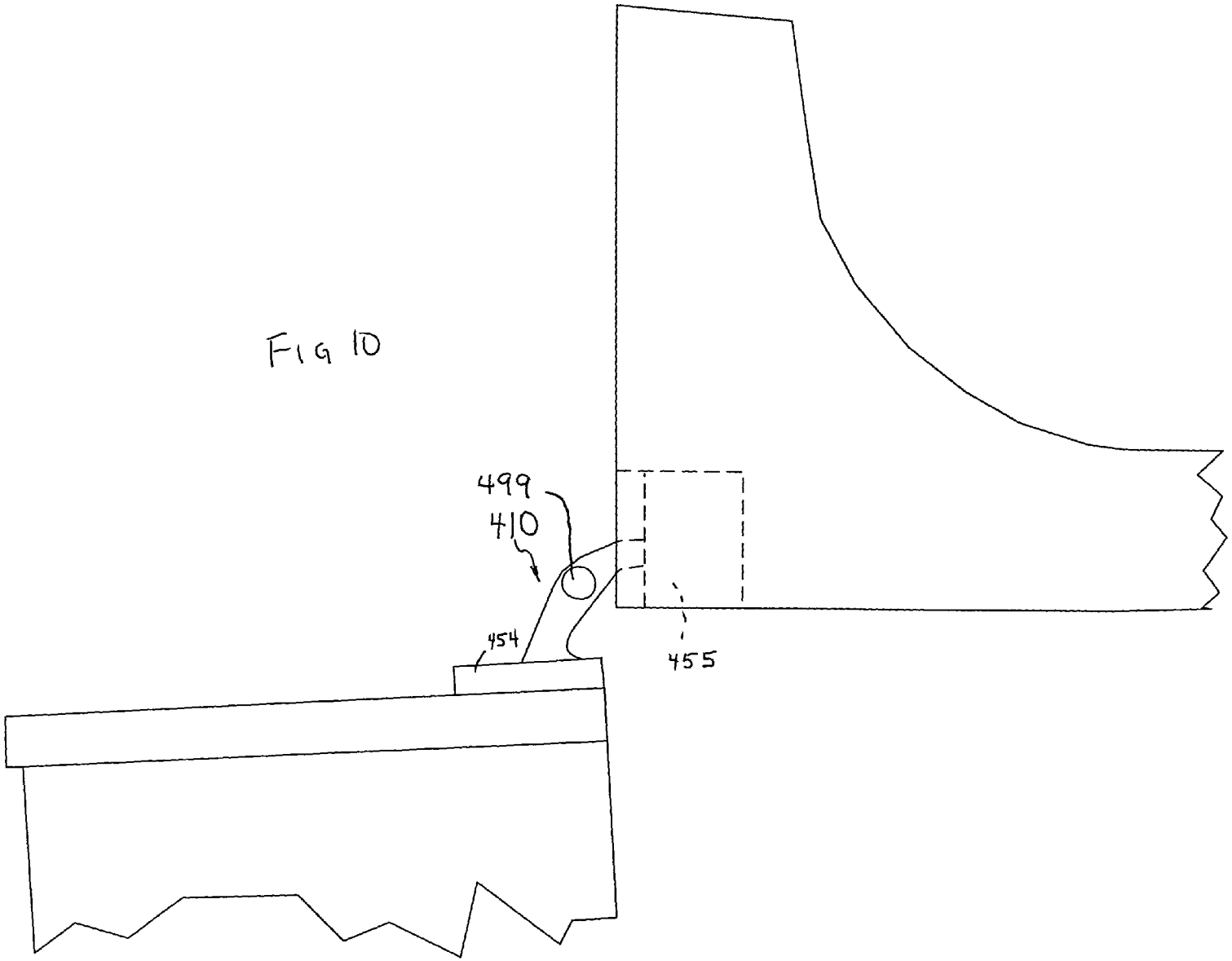
FIG. 10 is a side view of the hinge of FIG. 9 which may be employed in the inventive stringed musical instrument in a half-open position, viewed from the side, as the hinge would be deployed in a musical instrument such as a guitar or violin.
Figure 11:
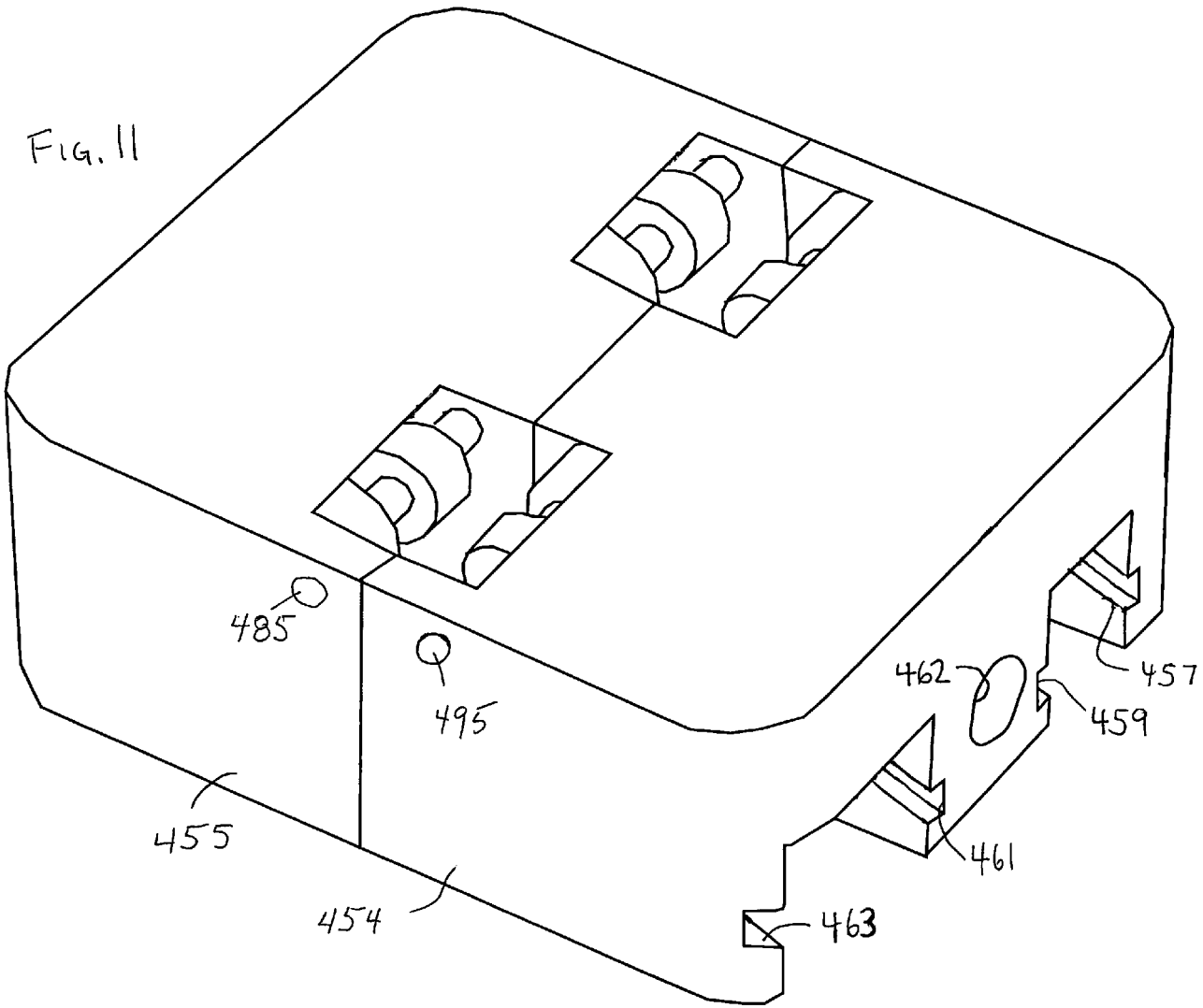
FIG. 11 is a bottom perspective view of the hinge of FIG. 9 in the playing position.
Figure 12:
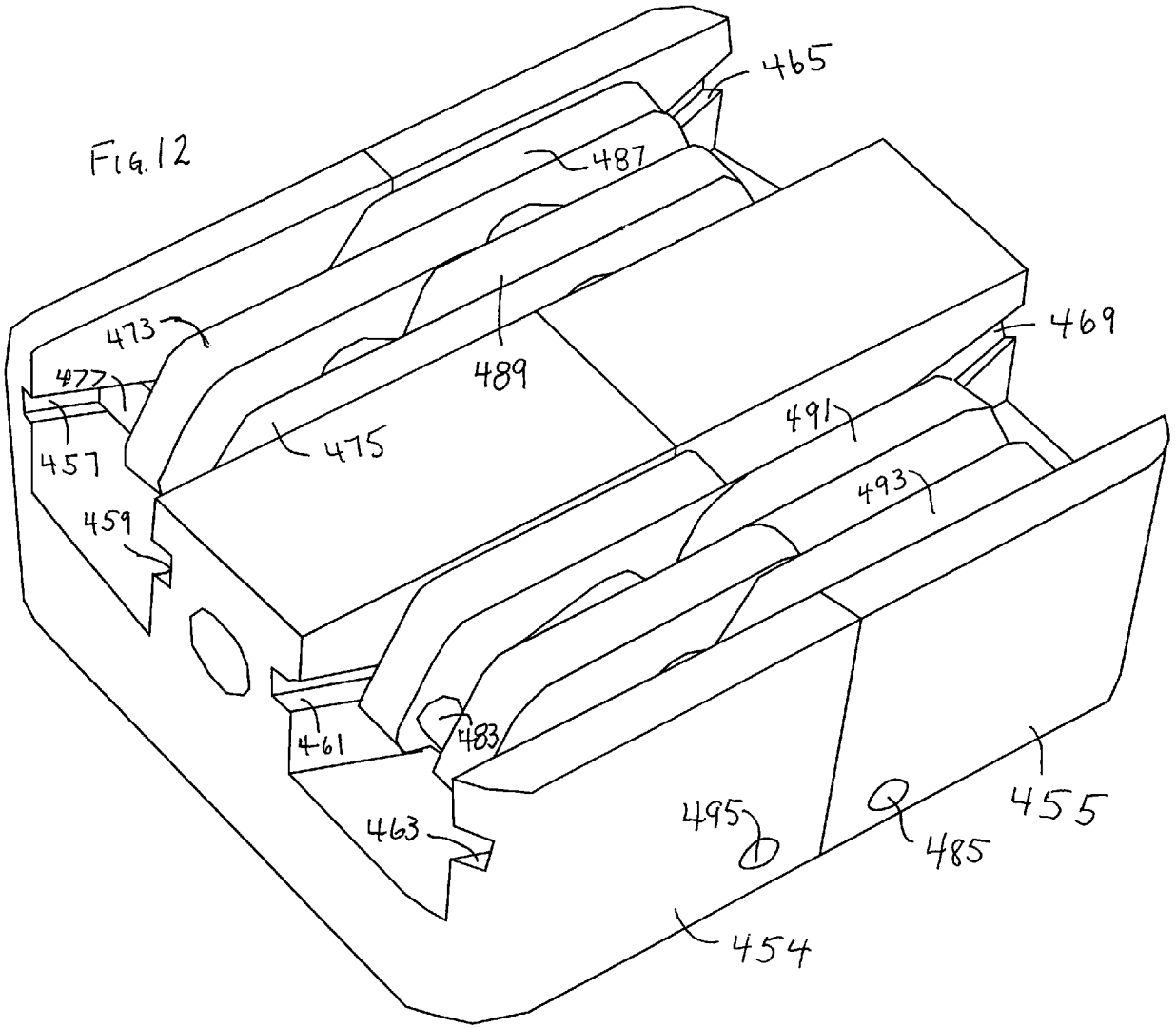
FIG. 12 is a top perspective view of the hinge of FIG. 9 in the playing position.

Referring to FIG. 9, a particularly advantageous hinge 410, useful for incorporation into a stringed musical instrument, such as a guitar having a folding neck, is illustrated. Incorporation in such a guitar is illustrated in FIG. 10. Hinge 410 comprises a pair of hinge butts 454 and 455. Hinge butt 454, as can be seen most clearly with reference to FIGS. 11 and 12, includes races 457 and 459 which face each other. In similar fashion hinge butt 454 also defines races 461 and 463, which are also in facing relationship to each other. In similar fashion, hinge butt 455 includes races 465 and 467 which face each other. In similar fashion hinge butt 454 also defines races 469 and 471, which are also in facing relationship to each other.

Hinging action is provided by a pair of Soss link assemblies 468 and 472. Soss link assembly 468 comprises Soss links 473 and 475, which support sliding pin 477, which slide in the race pair formed by races 457 and 459. Soss link assembly 468 comprises Soss links 473 and 475, which support sliding pin 477, which slide in the race pair formed by races 457 and 459. Soss link assembly 472 comprises Soss links 479 and 481, which support sliding pin 483, which slide in the race pair formed by races 461 and 463. The ends of links 473 and 475 opposite the ends which receive pin 477 are rotatably supported on pin 485 mounted in hinge butt 455.

In similar fashion, Soss links 487 and 489 receive a sliding pin which mounts in races 465 and 467, and Soss links 491 and 493 receive a sliding pin which mounts in races 469 and 471. Soss links 487, 489, 491 and 493 are rotatably mounted on pin 495 at the end opposite that which supports their respective sliding pins. Hinge 410 also includes a pair of pins 497 and 499. The ends of pins 497 and 499 are accommodated in recesses 498, when the hinge is in the position illustrated in FIG. 11. Finally, the hinge is secured and positioned by screws which pass through holes 460 and 462.

As illustrated in most clearly in FIG. 10, in accordance with a preferred environment of the invention, hinge 410 is mounted to have hinge butt 455 recessed into the guitar neck and hinge butt 454 protruding from the guitar body.

In accordance with the invention, it is contemplated, that while the guitar neck is folded down, the guitar strings will be inserted through the hole and into the body of the guitar. It is also contemplated that the inventive structures may be applied to a solid body guitar, such as an electric guitar. In this case, the hole which in an acoustic guitar leads into the body of the acoustic guitar does not exist. Thus, there is limited space for the strings. In accordance with the present invention, it is contemplated that a groove or troth, or cylindrical or spherical volume may be cut into the solid guitar to allow place for the placement of strings. Alternatively, a hole with a diameter of, for example, five centimeters may be cut in the guitar. The guitar strings may be passed through this hole, allowing them to be laid flat against the backside of the guitar.

While illustrative embodiments of the invention have been described, it is, of course, understood that various modifications will be obvious to those of ordinary skill in the art. Such modifications are within the spirit and scope of the invention as illustrated and defined only by the appended claims.

What is claimed is:

1. A string instrument, comprising:

(a) a neck extension primary member having a neck extension securement end and a tuning assembly support head end, an extension top and a length extending said ends, said neck extension primary member defining a substantially rectangular neck extension cutaway volume having a form defining a bottom surface configured to support a planar surface and having sidewalls, and said neck extension cutaway volume configured to receive a hinge butt, said neck extension cutaway volume extending to be open at said neck extension securement end and open at the top of said neck extension primary member;

(b) a neck base primary member having a neck base securement end, a base top and an opposite end, said neck base primary member being made to define a substantially rectangular neck base cutaway volume having a form defining bottom surface configured to support a planar surface and having sidewalls, and said neck extension cutaway volume configured to receive a hinge butt, said neck base cutaway volume extending to be open at said neck base securement end and open at the top of said neck base primary member;

(c) a hinge, comprising:

(i) a first hinge butt defining a first race pair and a second race pair for receiving first and second Soss sliding hinge pin, wherein said first hinge butt includes a first screw hole;

(ii) a second hinge butt defining a third and fourth race pairs for receiving a third and fourth Soss sliding hinge pins, wherein said second hinge butt includes a second screw hole;

(iii) a first Soss link assembly mounted between and in said first and third race pairs; and (iv) a second Soss link assembly mounted between and in said second and fourth race pairs, said second Soss link assembly being positioned adjacent, spaced apart from and extending in the same direction as said first Soss link assembly;

(d) a neck fretboard portion having a bottom surface defining a plane, said neck fretboard portion being secured over said open top of said neck extension cutaway volume and bearing against said first hinge butt;

(e) a base cover having a bottom surface defining a plane, said base cover being secured over said open top of said neck base cutaway volume and bearing against said second hinge butt; and (f) a string instrument sound box secured to said neck base primary member.

2. The string instrument as in claim 1, wherein said first hinge butt defines said first screw hole between said first and second race pairs, and wherein said second hinge butt defines said second screw hole between said third and fourth race pairs, said first screw hole and second screw hole being oriented to receive an attachment member for urging said hinge into a member to be hingedly mounted.

3. The string instrument as in claim 2, wherein said hinge butts are rectangular in configuration.

4. The string instrument as in claim 3, wherein said hinge butts have flat sides and rounded corners.

5. The string instrument as in claim 3, wherein said hinge butts have flat sides and pointed substantially 90° corners.

6. The string instrument as in claim 3, wherein said first screw hole between said first and said second races is aligned substantially in the same direction as its respective hinge butt.

7. The string instrument as in claim 6, wherein said second screw hole between said third and said fourth races is aligned substantially in the same direction as its respective hinge butt.

8. The string instrument as in claim 1, wherein said hinge is compressed when said string instrument is in a flat and open playing position.

9. The string instrument of claim 1, wherein said hinge is extended when said string instrument is in folded and closed travel position.

10. A string instrument, comprising:

(a) a neck extension primary member having a neck extension securement end and a tuning assembly support head end, an extension top and a length extending said ends, said neck extension primary member defining a substantially rectangular neck extension cutaway volume having a form defining a bottom surface configured to support a planar surface and having sidewalls, and said neck extension cutaway volume configured to receive a hinge butt, said neck extension cutaway volume extending to be open at said neck extension securement end and open at the top of said neck extension primary member;

(b) a neck base primary member having a neck base securement end, a base top and an opposite end, said neck base primary member being made to define a substantially rectangular neck base cutaway volume having a form defining bottom surface configured to support a planar surface and having sidewalls, and said neck extension cutaway volume configured to receive a hinge butt, said neck base cutaway volume extending to be open at said neck base securement end and open at the top of said neck base primary member;

(c) a hinge, comprising:

(i) a first hinge butt defining a first race pair and a second race pair for receiving first and second Soss sliding hinge pin, wherein said first hinge butt includes a first screw hole;

(ii) a second hinge butt defining a pair of third and fourth race pairs for receiving a third and fourth Soss sliding hinge pins, wherein said second hinge butt includes a second screw hole;

(iii) a first Soss link assembly mounted between and in said first and third race pairs;

(iv) a second Soss link assembly mounted between and in said second and fourth race pairs, said second Soss link assembly being positioned adjacent, spaced apart from and extending in the same direction as said first Soss link assembly;

(v) a first screw in said first screw hole mounted between said first and second Soss link assemblies on said first hinge butt; and (vi) a second screw in said second screw hole mounted between said first and second Soss link assemblies on said second hinge butt;

(d) a neck fretboard portion having a bottom surface defining a plane, said neck fretboard portion being secured over said open top of said neck extension cutaway volume and bearing against said first hinge butt;

(e) a base cover having a bottom surface defining a plane, said base cover being secured over said open top of said neck base cutaway volume and bearing against said second hinge butt; and (f) a string instrument sound box secured to said neck base primary member.

11. The string instrument as in claim 10 wherein a width of said hinge is narrower than said neck fretboard portion.

12. The string instrument as in claim 10 wherein said hinge has a width, and the width of said hinge is between 82% and 88% of the width of said first portion of said string instrument, wherein said first portion is a neck of said string instrument.

13. The string instrument as in claim 10 wherein said hinge has a width, and the width of said hinge is between 75% and 95% of the width of said neck fretboard portion.

14. The string instrument as in claim 10 wherein said hinge has a width, and the width of said hinge is between 40% and 95% of the width of said neck fretboard portion.

15. The string instrument of claim 10, wherein the width of said first and second Soss link assemblies is between 10 and 37% of the width of the hinge.

16. The string instrument of claim 10, wherein the width of said first and second Soss link assemblies is between 22% and 27% of the width of the hinge.

17. The string instrument of claim 10, wherein said the Soss link assemblies are mounted on respective pins, and said butts have recesses which accommodate protruding ends of said respective pins.

18. The string instrument of claim 10, wherein said screws extend parallel to the neck of said stringed instrument.

* * * * *